US006431736B1

(12) United States Patent
Saladin

(10) Patent No.: US 6,431,736 B1
(45) Date of Patent: Aug. 13, 2002

(54) ELLIPTICAL HEADLIGHT FOR MOTOR VEHICLE

(75) Inventor: Denis Saladin, Bourg la Reine (FR)

(73) Assignee: Valeo Vision, Bobigny (FR)

( * ) Notice: Subject to any disclaimer, the term of this patent is extended or adjusted under 35 U.S.C. 154(b) by 0 days.

(21) Appl. No.: 09/380,722

(22) PCT Filed: Jan. 8, 1999

(86) PCT No.: PCT/FR99/00020

§ 371 (c)(1),
(2), (4) Date: Sep. 7, 1999

(87) PCT Pub. No.: WO99/35438

PCT Pub. Date: Jul. 15, 1999

(30) Foreign Application Priority Data

Jan. 9, 1998 (FR) ..... 98 00339

(51) Int. Cl.[7] ..... F21V 7/00

(52) U.S. Cl. ..... 362/516; 362/297; 362/538; 362/302; 362/517

(58) Field of Search ..... 362/297, 298, 362/302, 349, 348, 516, 350, 538

(56) References Cited

U.S. PATENT DOCUMENTS 5,636,917 A * 6/1997 Furami et al. ..... 362/538

FOREIGN PATENT DOCUMENTS

| | | | |
|---|---|---|---|
| EP | 0 254 746 | | 2/1988 |
| EP | 254748 | * | 3/1988 |
| FR | 0 704 044 | | 10/1994 |
| JP | 1-255104 | | 10/1989 |
| JP | 255103 | * | 12/1989 |

* cited by examiner

*Primary Examiner*—Sandra O'Shea
*Assistant Examiner*—Ali Alavi
(74) *Attorney, Agent, or Firm*—Morgan & Finnegan LLP

(57) ABSTRACT

A headlight for a motor vehicle is provided for generating a light beam, and particularly a dipped beam, of a given configuration. The headlight has a light source, a reflector of the elliptical type having a first focus in the vicinity of which the light source is situated, and a lens placed in front of the reflector. The reflector has at least two zones which are situated side by side and which are adapted to form, in a focal region of the lens, patches of light which are preformed in width, and overlap each other in a horizontal direction.

13 Claims, 4 Drawing Sheets

ELLIPTICAL HEADLIGHT FOR MOTOR VEHICLE

BACKGROUND OF THE INVENTION

The present invention relates in general terms to headlights of the elliptical type for motor vehicles.

Generally, a headlight of this type includes a reflector having a zone with a first focus, in the vicinity of which a light source is located, together with a zone with a second focus in the vicinity of which the radiation from the source is concentrated after being reflected by the reflector. A lens, which is typically a planar-convex spherical lens, is focused in the vicinity of the second focal zone, and projects the said concentrated radiation on the road.

It is also conventional to provide, in the second focal zone, a screen which is designed to occult part of the radiation and which has an upper edge that defines, in the beam which is formed, a cut-off line whereby to obtain a cut-off beam, and in particular a dipped beam.

Although these known headlights conventionally had a reflector in the form of an ellipsoid of revolution, with first and second point foci, the Applicant has recently proposed modification of such a reflector in order to generate, in the focal plane of the lens, a concentrated patch of light which is pre-widened, so as to give the required width to the projected beam.

In this way, recourse to optical elements (such as striations, prisms etc.), for spreading the light sideways, is limited by a substantial amount, such elements being always tricky to apply in a headlight of the type for projecting a light image of the kind produced by a headlight of the elliptical type.

The document FR-A-2 704 044 describes such a modified reflector.

However, the reflector described in that document does have certain other limitations. In particular, the very nature of the reflector leads to a beam for which a photometric study shows that it is capable of being improved.

It is useful to recall here that a satisfactory dipped beam, that is to say one having the maximum amount of visual comfort for the driver while conforming with the regulations in force, must include a patch of light having a relatively pointed concentration, either along the axis of travel, or slightly offset laterally towards the nearside (that is to say towards the right for driving on the right), and must also have a relatively homogeneous light over a certain width on either side of the patch of light concentration, with a relatively regular transition between the concentration and the spread light.

Now, the reflector of the above type leads in general to a beam which has a concentration zone of excessive width, and as a result, an excessively feeble light intensity. A further limitation of this known headlight lies in the fact that the beam may be insufficiently thick, that is to say it may have a high concentration of light just under the cut-off line, but not enough to illuminate the road closer to the vehicle.

In addition, the beams generated by headlights of the above type are generally of relatively reduced thickness, and in all cases they are difficult to control, although it is above all desirable to have, at least in the case of a dipped beam, a beam that is of substantial width towards the nearside, and which at the same time does not give rise to too much light in the axis of the vehicle and too close to the latter.

BRIEF SUMMARY OF THE INVENTION

The present invention aims to overcome these disadvantages in the state of the art, and to propose a headlight of the above mentioned type in which the beam obtained is improved.

Another object of the present invention is to give the designer more flexibility in obtaining various features of the beam, such as width and intensity of the patch of light concentration, and evolution of the intensity towards the side edges of the beam.

Finally, another object of the present invention is to propose a headlight in which the thickness of the beam generated can be controlled more easily and with greater flexibility during its design.

Accordingly, the invention proposes a motor vehicle headlight, of the type adapted to generate a light beam of given configuration and comprising a light source, a reflector of the elliptical type, having a first focus in the vicinity of which the light source is situated, and a lens located in front of the reflector, is characterised in that the reflector has at least two zones which are situated side by side and which are adapted to form, in a focal region of the lens, patches of light which are preformed in width, and in that the patches overlap each other in a horizontal direction.

Features, preferred but not limiting, of the headlight in accordance with the invention are as follows:

- each zone of the reflector has a surface with a horizontal generatrix such that the rays which it reflects from the rays issued from the source lie in vertical planes which intersect an imaginary line at two points, of which the curvilinear abscissas evolve on the said line in accordance with a predetermined law;
- the said imaginary lines of the different zones are continuous;
- the said imaginary lines of the different zones are curves;
- each curve is spaced away from the focal region of the lens, in a direction parallel to the axis of the reflector, by an amount which is greater the more the said curve is spaced laterally away from the said axis;
- in each zone of the reflector, a vertical section of the said reflector situated in a vertical plane containing the ray reflected by the horizontal generatrix is adapted to concentrate the said rays reflected on the said associated point of the imaginary line, the said imaginary line being a line of secondary foci, and the said points being secondary foci;
- in at least part of one of the zones, an upper region of a vertical section is adapted to concentrate the rays which it reflects on another point which is situated between the said associated secondary focus and the lens;
- on either side of a transition line between two adjacent zones, the vertical sections of the said zones have lines of secondary foci which are not superimposed;
- the said transition line is determined by the intersection of the surfaces of the said zones, and the said transition line is distinct from the respective lines of constant horizontal deviation of the said zones;
- the reflector has two zones which are separated by a transition line extending horizontally, substantially in the middle of the reflector;

the reflector has three zones which are separated by two transition lines lying on either side of the axis of the reflector;

a central zone of the reflector is substantially narrower in the horizontal direction than two lateral zones;

the headlight further includes a mask situated in the focal region of the said lens, so as to generate a cut-off beam;

the said lines of secondary foci are situated in the axial direction between the mask and the lens.

BRIEF DESCRIPTION OF THE DRAWINGS

Further features, objects and advantages of the present invention will appear more clearly on a reading of the following detailed description of preferred embodiments of the latter, which are given by way of example and with reference to the attached drawings, in which.

DETAILED DESCRIPTION OF THE INVENTION

Figure 1:
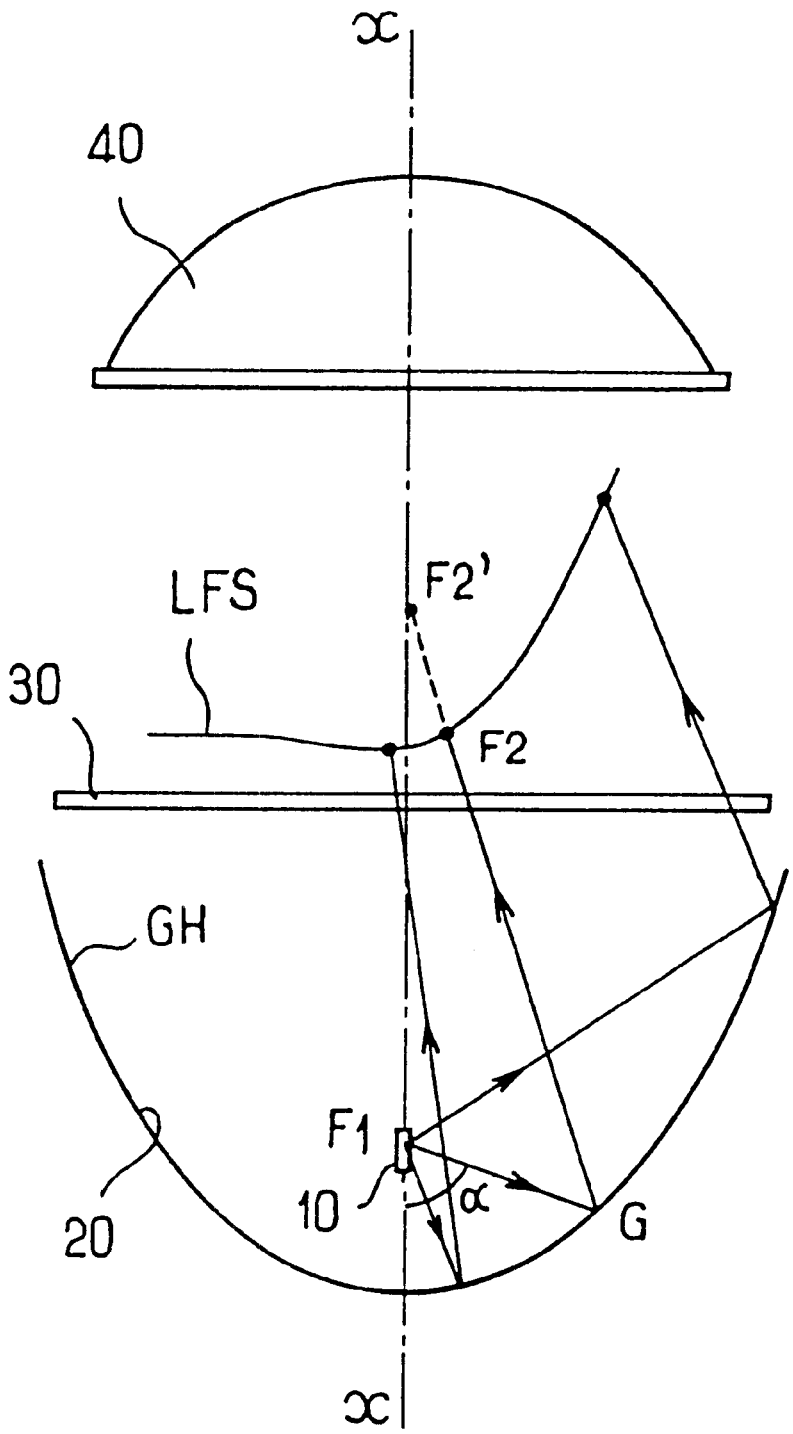
FIG. 1 shows, in a diagrammatic partial view in horizontal cross section, the principle of construction of a zone of the reflector of a headlight in accordance with the invention.

With reference first to FIG. 1, this shows diagrammatically elements of a headlight in accordance with the invention, which includes a light source 10, a reflector 20, a screen or occulting mask 30, and a lens 40.

The source 10 is typically the filament of an incandescent lamp or the arc of a discharge lamp.

The mask 30 has for example, and in a manner which is conventional per se, an upper edge which is defined by two segments of straight lines which together define an inverted and flattened V, in such a way as to generate a dipped beam which conforms with the relevant European regulations.

The lens 40 is for example a flat or convex spherical lens with a point focus, or it may be a toroidal lens.

The reflector 20 is constructed in accordance with principles similar to those described in the document FR-A-2 704 044, to which reference should be made for more detail, but with differences from those principles which will be explained later herein.

First, and as will be seen in greater detail later herein, the reflector consists of at least two zones which are constructed individually, and which are joined along slightly bent transition lines which extend generally downwards.

Each of these zones is constructed as will be described below.

The method begins by defining a horizontal generatrix GH similar to that described in FR-A-2 704 044, which is illustrated by the fact that the ray F1G emitted by the source towards the reflective surface of the zone to be constructed, at the level of its horizontal generatrix, is arranged to be reflected in a ray GF2 which intersects a line of secondary foci LFS at a point F2, the position of which, or curvilinear abscissa, on the line LFS, varies as a function of the angle $\alpha$ of the radius F1G with respect to the optical axis X—X. It is possible to demonstrate easily that this leads to the use of a horizontal generatrix the equation of which is given at the bottom of page 8 of the above mentioned document FR-A-2 704 044.

A difference from the arrangements described in that document is that the line LFS also enables the focusing of the section of the reflector situated in the vertical plane containing the reflected ray GF2, to be controlled.

It will be noted here that the line LFS may be any shape of curve whatever, and is preferably without any discontinuity, so that discontinuities are avoided in the generated surface.

Figure 2:
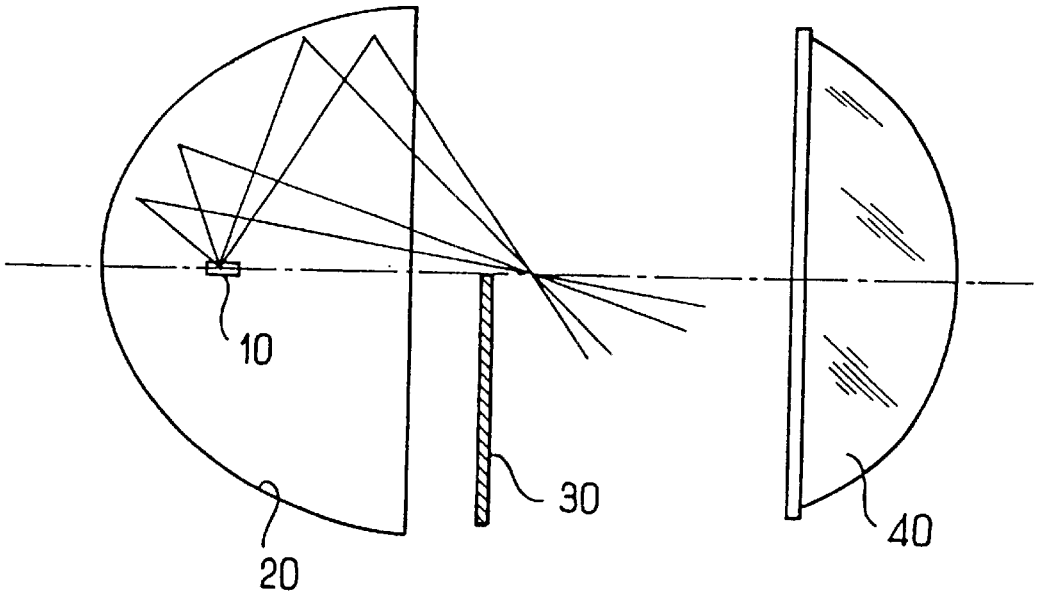
FIG. 2 shows, in a diagrammatic partial view in vertical cross section, a first form of construction of the vertical sections of the mirror.

In the basic embodiment shown in FIG. 2, the whole of this section is adapted to focus the rays reflected by it on the point F2, the distance of which, measured along the axis X—X, with respect to the plane of the mask 30, is able to vary substantially along the curve LFS.

Each of these sections is therefore an elementary section of an ellipsoid of revolution, having the foci F1 and F2, and the parameters of this ellipsoid vary to the extent that the point F2 is displaced along the curve LFS.

It will be understood here that the profile of the curve LFS mentioned above not only enables the width of the patch of light that will be formed in the plane of the mask 30 to be controlled, but it also enables the thickness of this patch of light to be controlled, the latter being of increasing magnitude the further the point F2 is located in front of the mask 30.

Figure 3:
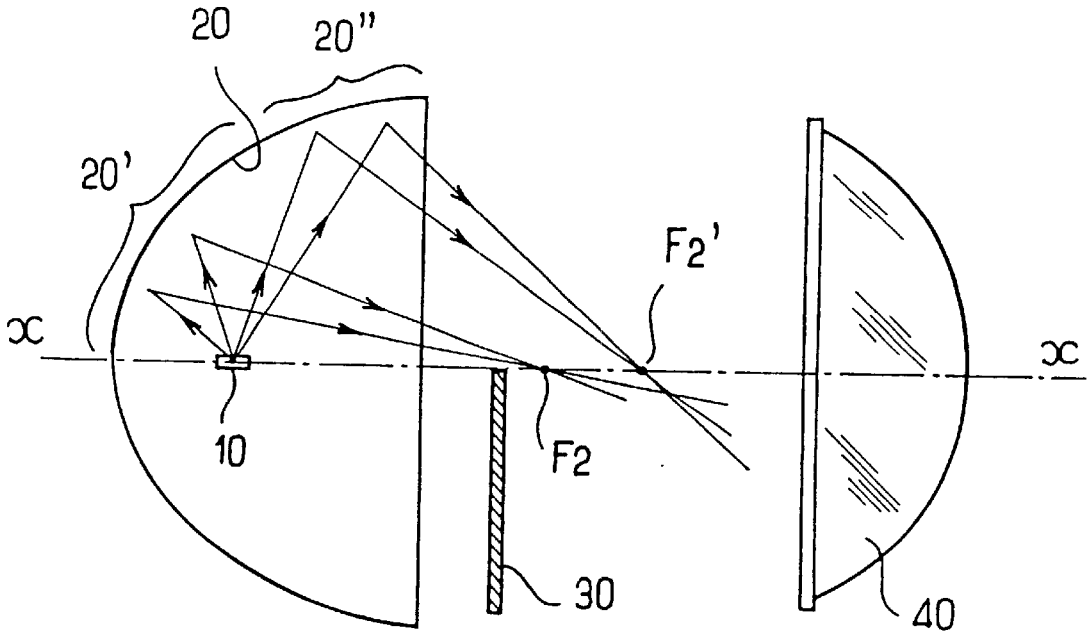
FIG. 3 shows, by a diagrammatic partial view in vertical cross section, a second form of construction of the vertical sections of the mirror.

FIG. 3 illustrates another version of certain vertical sections of the mirror 20, in which a portion 20' of the section shown in that Figure behaves in the same way as in the case of FIG. 2, that is to say it concentrates the radiation reflected on the point F2, while an upper portion 20" of this section will concentrate the radiation reflected on a point F2' which is spaced away, and in front of, F2, that is to say towards the lens. Another result is that the thickness of the patch of light in the plane of the mask 30, and therefore the thickness of the projected beam, are increased at will.

It will be observed here that the reflective surfaces giving the optical behaviours corresponding to FIGS. 2 and 3 can easily be deduced from the surface equation given on page 9 of FR-A-2 704 044.

Given, here, that the surface design described above is applicable to one of two or more zones, the reflector 20 is accordingly defined by designing a first zone, characterised by a certain curve LFS and a certain rule for the evolution of the position of the points F2 on the said line as a function of the angle α of the rays emitted by the source, and at least one second zone characterised by another rule of evolution of the position of the points F2, and, if necessary, by a further line LFS the trajectory of which is different from that which corresponds to the first zone.

In addition, and in accordance with a major feature of the invention, the rules for evolution of the positions of the points F2 between one zone of the reflector and an adjacent zone are such that there exists an overlap, in the widthwise direction, between the radiation produced in the plane of the mask 30 by one zone and the radiation produced in the same plane by the adjacent zone. This is achieved by designing the rules for evolution of the points F2 on the respective lines LFS, in such a way that, for respective predetermined fractions of the first and second zones which are adjacent to the transition between the two zones, the horizontal angular intervals covered by the rays reflected by these fractions of zones overlap. It will easily be understood that, in this way, there exists at the level of the boundary between these two zones a slight bend, that is to say it has no mathematical differential, between the neighbouring reflective surfaces.

In addition, in order to ensure between two adjacent zones a transition which preferably extends substantially vertically, the parameters of the reflective surfaces of the two zones, defined essentially by the trajectory of the respective curves LFS and by the rules of evolution F2=f (α) on these curves, are chosen in such a way as to obtain this type of transition. This, in particular, implies that the axial positions of the respective curves LFS with respect to the plane of the mask 30 must be reasonably close to each other as regards the fractions of zones having overlapping fields in terms of horizontal deviation.

Figure 4:
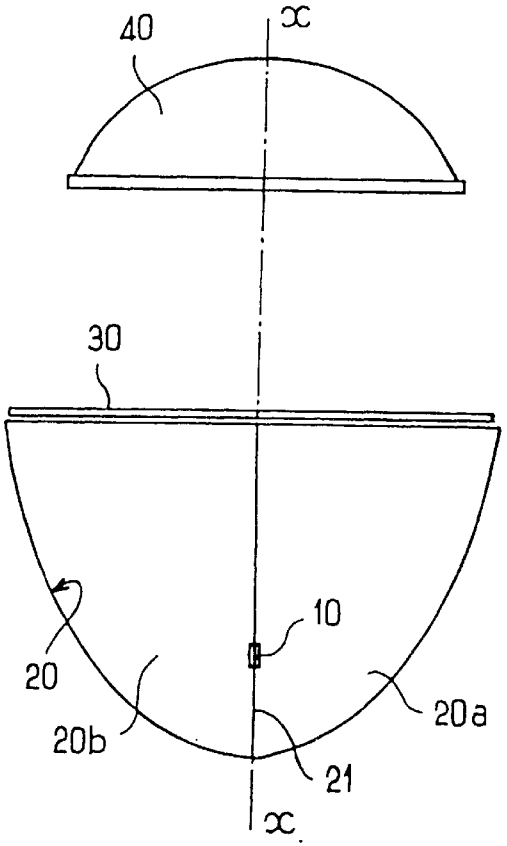
FIG. 4 is a diagrammatic partial view in horizontal cross section, of a headlight in a first actual embodiment of the invention.

FIG. 4 illustrates diagrammatically a first actual embodiment of a reflector of a headlight in accordance with the invention, with two zones 20*a* and 20*b* which are designed in the manner described above, and which are separated by a transition edge 21 which extends substantially to the middle of the reflector.

Figure 5A:
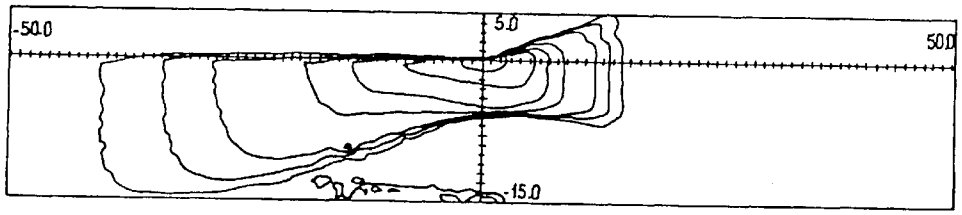
FIGS. 5*a* and 5*b* show, by sets of isolux curves, the light distribution of the portions of the beam generated by two individual regions of the reflector of the headlight of FIG. 4.
Figure 5B:
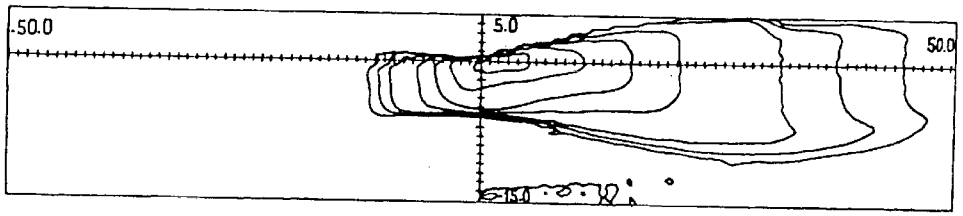

FIGS. 5*a* and 5*b* illustrate the portions of the beam that are projected by the lens 40 from the patches of light which are formed respectively by these two zones, and with the intervention of the mask 30.

It will be observed that the beam portion generated by the zone 20*a* in combination with the mask 30 and the lens 40 (FIG. 5*a*) is offset substantially towards the right with respect to the central vertical axis of the projection screen, and that in the opposite direction, the beam portion generated by the zone 20*b* in combination with the screen 30 and the lens 40 (FIG. 5*b*) is offset substantially towards the left with respect to the central axis of the screen.

It will also be observed that these offsets of the respective beam portions have no sharp edges of light, but that, on the contrary, the quantity of light diminishes progressively, as is represented by the spacing between the isolux curves. It will be noted here that this absence of any sharp edge is obtained when the transition edge between the two zones 20*a* and 20*b* does not follow a line of constant horizontal deviation of the light, that is to say it will not be superimposed on a line of each zone which would give the same horizontal deviation to the reflected rays. Typically, this is achieved by giving the curves LFS in the two zones different axial positions in the region of their portions which are touched by the rays reflected by the regions of the zones 20*a*, 20*b* adjacent to the boundary 21, and by determining the line 21 as being the line of intersection between the two surfaces thus defined.

Figure 6:
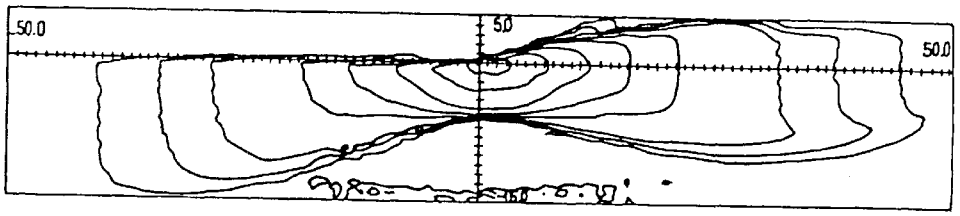
FIG. 6 shows, by a set of isolux curves, the light distribution of the beam which is generally obtained.

In this way, the two beam portions will combine in a general beam (FIG. 6) which has an excellent homogeneity, as well as a concentration in the axis which is very pronounced and at the same time progressively blended with the wider portions of the beam.

Figure 8A:
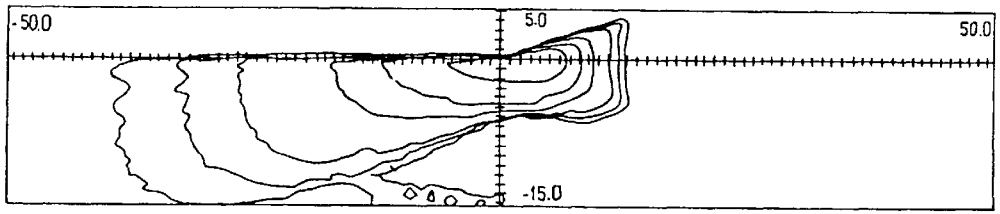
FIGS. 8*a* to 8*c* show, by sets of isolux curves, the light distribution of the portions of the beam which are generated by three individual regions of the reflector of the headlight of FIG. 7.
Figure 8B:
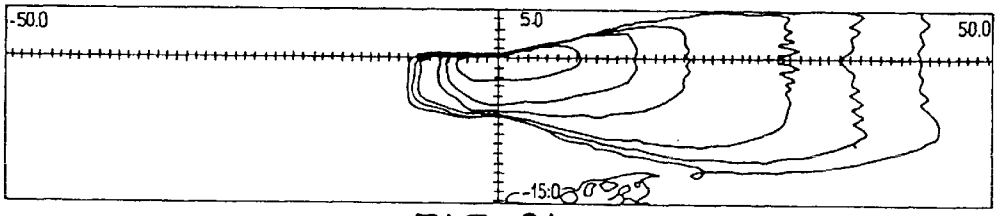
Figure 8C:
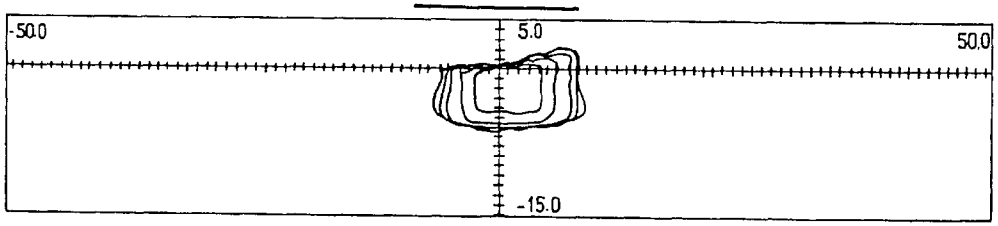
Figure 9:
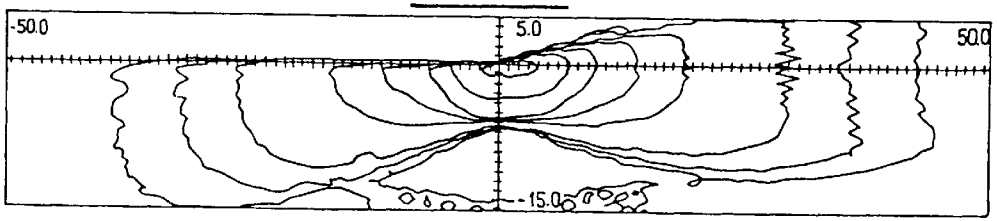
FIG. 9 shows, by a set of isolux curves, the light distribution of the beam generally obtained.
Figure 7:
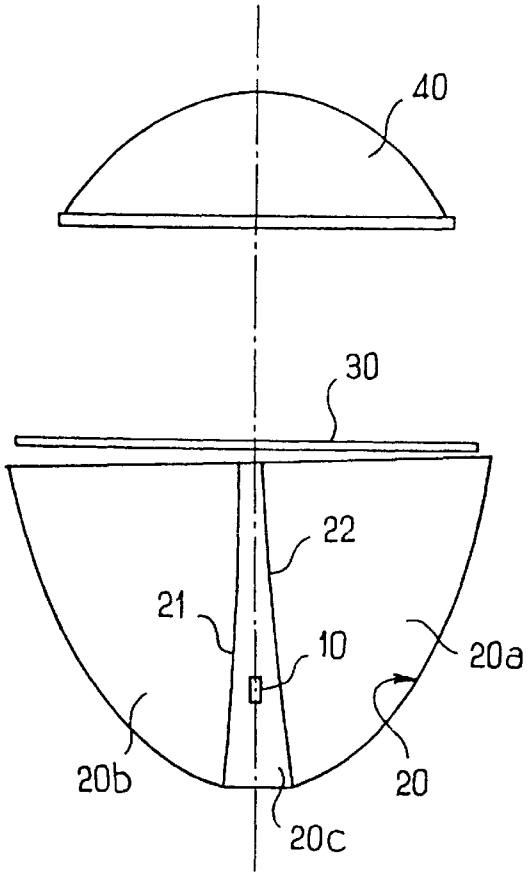
FIG. 7 is a diagrammatic partial view in horizontal cross section, of a headlight in a second embodiment of the invention.

FIG. 7 shows a second embodiment of a headlight reflector in accordance with the invention. This time it has three zones, with two lateral zones 20*a*, 20*b* which are separated by a substantially narrower central zone. Here again, the parameters used in the design of the individual surfaces are such that the two transition lines 21 and 22 between the adjacent zones do not correspond to the lines of constant horizontal deviation, so that the three corresponding beam portions, as shown in FIGS. 8*a*, 8*b* and 8*c* respectively, have lateral edges with progressive fading of the light. This results in fusion of the said beam portions so as to form a homogeneous general beam, which has the same qualities as in the case of FIG. 6, with however a greater level of central concentration.

It will be understood here that by varying the width of the zone 20*c* and the lateral spacing (and, if necessary, the thickening) which it produces, the appearance of the beam can be varied with a high degree of flexibility.

The present invention is of course in no way limited to the embodiments described and shown, but the person working in this technical field will be able to apply any variant or modification in accordance with the spirit thereof.

In particular, it will be understood that a headlight reflector in accordance with the invention may be sub-divided into as many zones as necessary, so that the beam can be modelled as a function of the photometric requirements, both as regards the regulations and as regards visual comfort.

It will also be clearly understood that the invention is applicable to the generation of any type of beam, whether or not limited by a cut-off (the mask 30 being absent in this last case).

Finally, it is important to note here that the invention is fundamentally different from the case in which two patches of light formed by two different zones of the same reflector, for example an elliptical reflector, overlap due to the fact that the light source is not a point source, but it envisages all those cases in which the overlap between the said patches of light goes beyond the overlap, in the uncontrolled region, which would be obtained with conventional surfaces.

What is claimed is:

1. A motor vehicle headlight adapted to generate a light beam extending in a horizontal direction and a vertical direction, comprising:

a light source, a reflector of the elliptical type having a first focus in the vicinity of which the light source is situated, and a lens located in front of the reflector, wherein the reflector has at least two zones which are situated side by side, said at least two zones having a transition therebetween that extends substantially in the vertical direction and said at least two zones adapted to form, in a focal region of the lens, patches of light which are preformed in width, the patches overlapping each other in the horizontal direction, wherein each zone of the reflector has a surface with a horizontal generatrix such that the rays which it reflects from the rays issued from the source lie in vertical planes which intersect an imaginary line at two points, of which curvilinear abscissas evolve on said line in accordance with a predetermined law.

2. A headlight according to claim 1, wherein said imaginary lines of the different zones are continuous.

3. A headlight according to claim 1, wherein said imaginary line of the different zones are curves.

4. A headlight according to claim 3, wherein the reflector defines an axis and wherein each curve is spaced away from the focal region of the lens, in a direction parallel to the axis of the reflector, by an amount which is greater the more the said curve is spaced laterally away from the said axis.

5. A headlight according to claim 1, wherein in that each zone of the reflector, a vertical section of the reflector situated in a vertical plane containing the ray reflected by the horizontal generatrix is adapted to concentrate the rays reflected on the associated point of the imaginary line, the imaginary line being a line of secondary foci, and the said points being secondary foci.

6. A headlight according to claim 5, wherein at least part of one of the zones, an upper region of a vertical section is adapted to concentrate the rays which it reflects on another point which is situated between the associated secondary focus and the lens.

7. A headlight according to claim 5, wherein on either side of a transition line between two adjacent zones, the vertical sections of the zones have lines of secondary foci which are not superimposed.

8. A headlight according to claim 7, wherein the transition line is determined by the intersection of the surfaces of the zones, and wherein the transition line is distinct from the respective lines of constant horizontal deviation of the zones.

9. A headlight according to claim 1, wherein the reflector has two zones which are separated by a transition line extending horizontally, substantially in the middle of the reflector.

10. A headlight according to claim 1, wherein the reflector has three zones which are separated by two transition lines lying on either side of the axis of the reflector.

11. A headlight according to claim 10, wherein a central zone of the reflector is substantially narrower in the horizontal direction that two lateral zones.

12. A headlight according to claim 1, which further includes a mask situated in the focal region of the said lens, so as to generate a cut-off beam.

13. A headlight according to claim 12, wherein the said lines of secondary foci are situated in the axial direction between the mark and the lens.

* * * * *